US010335643B2

(12) United States Patent
Arnold et al.

(10) Patent No.: US 10,335,643 B2
(45) Date of Patent: Jul. 2, 2019

(54) AUTOMATIC GOLF BALL WASHER

(71) Applicant: Arnstone Products, Inc., Glen Ellyn, IL (US)

(72) Inventors: Eric Arnold, Glen Ellyn, IL (US); Daniel Johnstone, Manchester, NY (US)

(73) Assignee: Arnstone Products, Inc., Glen Ellyn, IL (US)

( * ) Notice: Subject to any disclaimer, the term of this patent is extended or adjusted under 35 U.S.C. 154(b) by 465 days.

(21) Appl. No.: 14/810,057

(22) Filed: Jul. 27, 2015

(65) Prior Publication Data

US 2016/0184660 A1 Jun. 30, 2016

Related U.S. Application Data

(60) Provisional application No. 62/029,189, filed on Jul. 25, 2014.

(51) Int. Cl.

| | |
|---|---|
| ***A63B 47/04*** | (2006.01) |
| ***B08B 3/10*** | (2006.01) |
| ***A63D 5/10*** | (2006.01) |
| ***B08B 1/00*** | (2006.01) |
| *A63B 102/32* | (2015.01) |

(52) U.S. Cl.

CPC ..... *A63B 47/04* (2013.01); *A63D 5/10* (2013.01); *B08B 1/00* (2013.01); *B08B 3/10* (2013.01); *A63B 2047/046* (2013.01); *A63B 2102/32* (2015.10)

(58) Field of Classification Search

None

See application file for complete search history.

(56) References Cited

U.S. PATENT DOCUMENTS

| | | | | |
|---|---|---|---|---|
| 3,654,655 A * | 4/1972 | Mitnick | ..... | A63B 47/04 15/21.2 |
| 4,381,574 A | 5/1983 | Benkovsky | | |
| 5,400,455 A | 3/1995 | Crossley | | |
| 5,524,311 A * | 6/1996 | Crossley | ..... | A63B 47/04 15/21.1 |
| 5,546,629 A * | 8/1996 | Shim | ..... | A63B 47/04 134/142 |
| 6,021,537 A | 2/2000 | Smith | | |

OTHER PUBLICATIONS

Arnstone, Screenshots of Youtube Video Arnstone Product, Jun. 2011.

* cited by examiner

*Primary Examiner* — Jiong-Ping Lu

(74) *Attorney, Agent, or Firm* — Erickson Law Group, PC

(57) ABSTRACT

An automatic golf ball washer includes a substantially enclosed body that can receive one or more golf balls onto a rotary carriage that spins the golf ball within a supply of washing fluid and contacts the moving golf ball with stationary brushes within the body.

10 Claims, 26 Drawing Sheets

Dual Ball Cradle

AUTOMATIC GOLF BALL WASHER

The application claims the benefit of U.S. Provisional Application 62/029,189, filed Jul. 25, 2014.

FIELD OF THE INVENTION

The present invention relates to an apparatus for washing golf balls, more particularly to an automatic washer providing a timed cleaning cycle with capability to provide a multiple magazine for cleaning.

BACKGROUND OF THE INVENTION

Golfing is a pleasurable sport enjoyed by millions around the world every year. A substantially white ball is played onto a green field toward a hole. Once the ball is significantly advanced from the vicinity of the player, it can be more easily located if it is clean. Further, it is advantageous to the travel of the ball being free from debris.

The present inventors have recognized the need for an automatic golf ball washer that does not require one to hold down a button to clean. The present inventors have recognized the need for an automatic golf ball washer that has the capability to wash two or more golf balls at once.

SUMMARY OF THE INVENTION

The present invention provides an automatic golf ball washer that includes a substantially enclosed body that can receive one or more golf balls onto a rotary carriage that spins the golf ball within a supply of washing fluid and contacts the moving golf ball with stationary brushes within the body.

In accordance with one embodiment of the present invention, there is provided an automatic golf ball washer that is cylinder in shape and held vertical, with dimensions about 5 inches×10 inches. The automatic golf ball washer is mounted to a golf cart, front or back on any 1×1 support bar. Located on the top third portion of the cylinder is a housing for the motor and electronics. Located below is a water/soap container and a golf ball carriage that hold 1-2 golf balls. Located behind the cylinder and secured to the back portion of the unit is a plunger handle that when pushed down, opens the bottom portion to allow the golfer to place 1-2 golf balls inside. Spring loaded, the bottom portion moves upward to secure the cylinder tight.

Located on top of the unit is a button, that when pressed, engages the wash cycle for up to 12 seconds or less, i.e., a controlled timing. During the wash cycle, the golf balls rotate clockwise, pressing against a rubber fabric that cleans the golf balls. The golf balls are also rotated by a rubber flap mounted to the back of the wash cylinder allowing the golf balls to easily flip for cleaning.

Optionally, located above each unit is an LCD screen for digital advertising. The LCD screen is attached to units specifically sold to golf courses with fleet carts. Units sold to the private golf cart owner can come without the LCD screen.

According to a second embodiment, a brush is provided within the reservoir and a brush is provided above the carriage or ball tray.

The present invention discloses an automatic timed golf ball cleaner. One would simply push the button once, and the cleaning cycle starts and stops automatically.

The present invention version spins the entire carriage that the ball sits on, providing the possibility to clean two balls at a time. This also allows the brush material to be swapped out easily for replacements, and also provides a much more thorough cleaning cycle.

The present invention is an advancement over the art in at least the following ways:

a.) Multiple ball capacity b.) Replaceable cleaning media designed into the functionality c.) Automatic, and timed clean cycle for hands free cleaning d.) Specifically designed to be mounted to a golf cart, increasing the available market coverage to include courses as well as private cart owners e.) Design easily facilitates the addition of advertising sources Numerous other advantages and features of the present invention will become readily apparent from the following detailed description of the invention and the embodiments thereof, from the claims and from the accompanying drawings.

BRIEF DESCRIPTION OF THE DRAWINGS

A complete understanding of the present invention may be obtained by reference to the accompanying drawings, when considered in conjunction with the subsequent, detailed description, in which.

DETAILED DESCRIPTION

Figure 1:
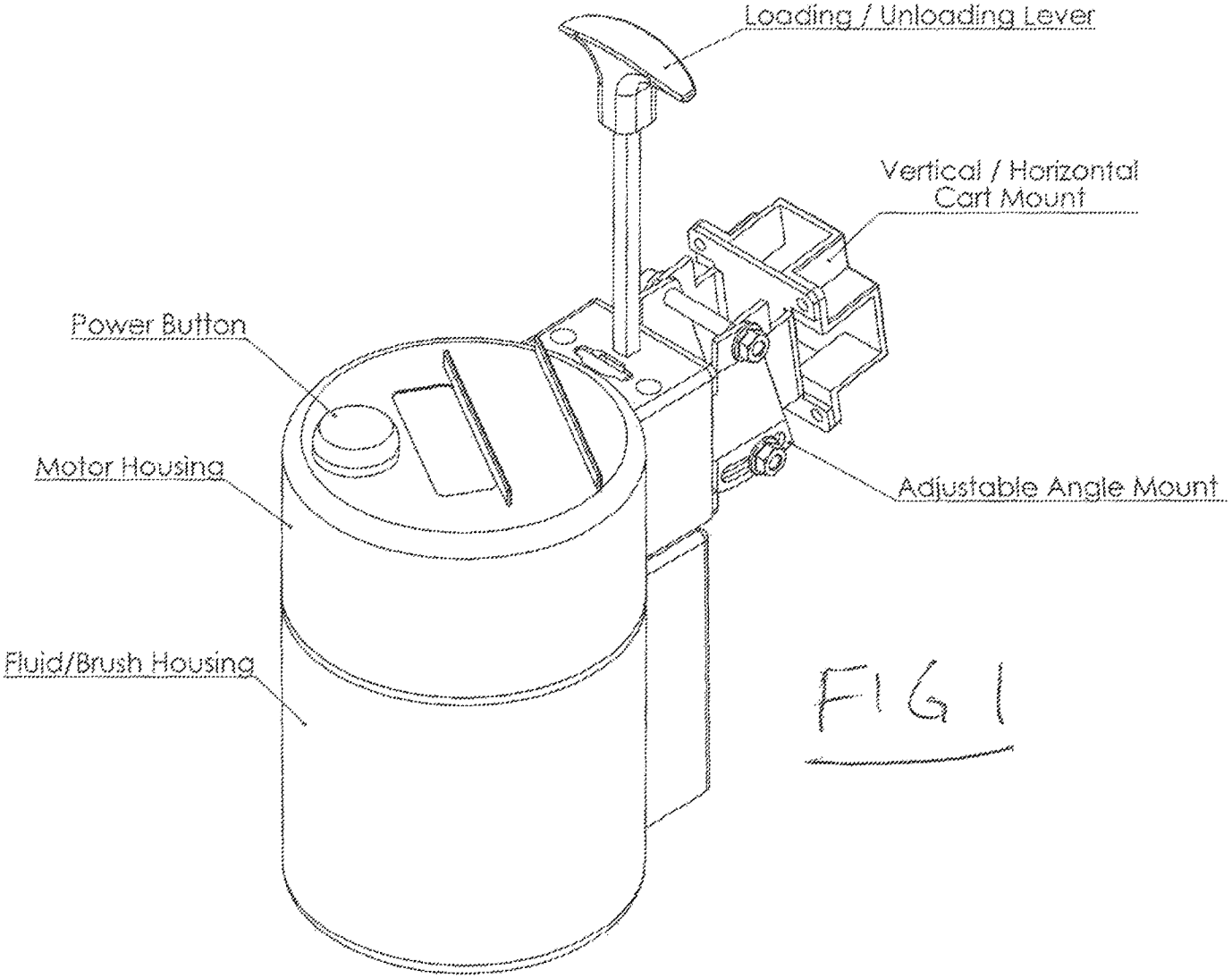
FIG. 1 is a perspective view of one embodiment of the invention showing major components and one embodiment for mounting hardware.
Figure 2:
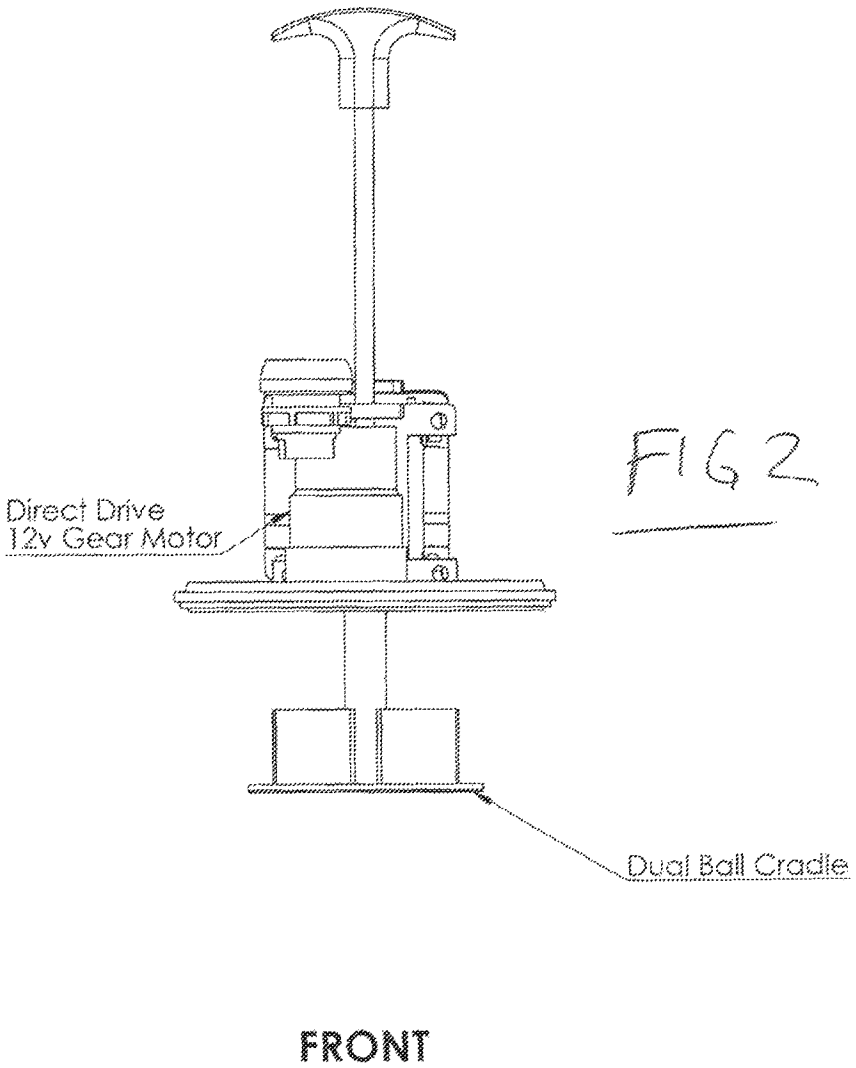
FIG. 2 is an orthogonal front view detailing the gear motor and having a dual ball cradle.
Figure 3:
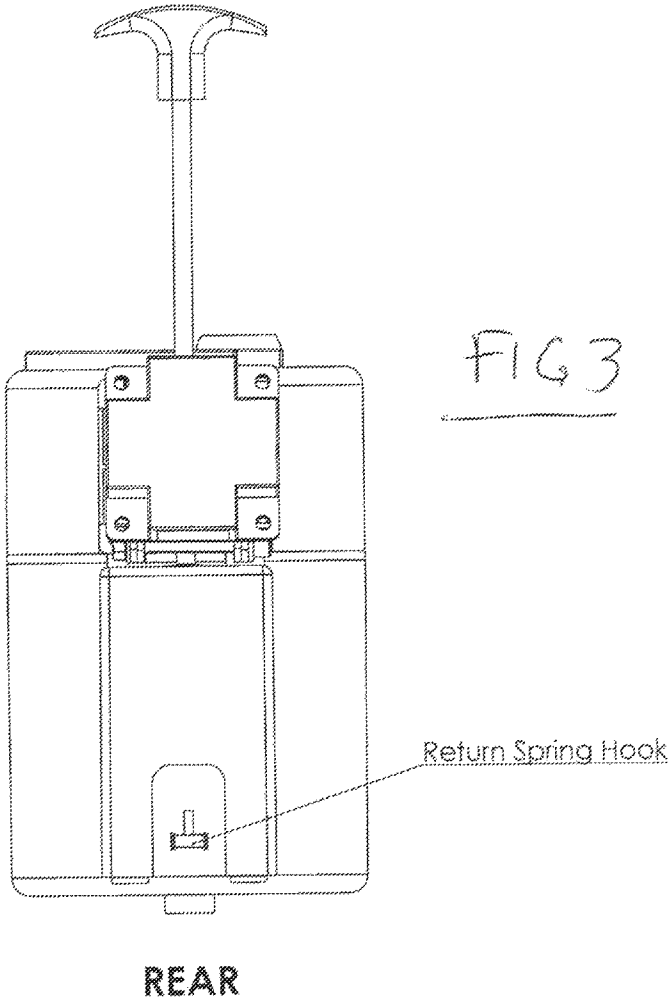
FIG. 3 is an orthogonal rear view detailing a spring hook for attachment detachment.
Figure 4:
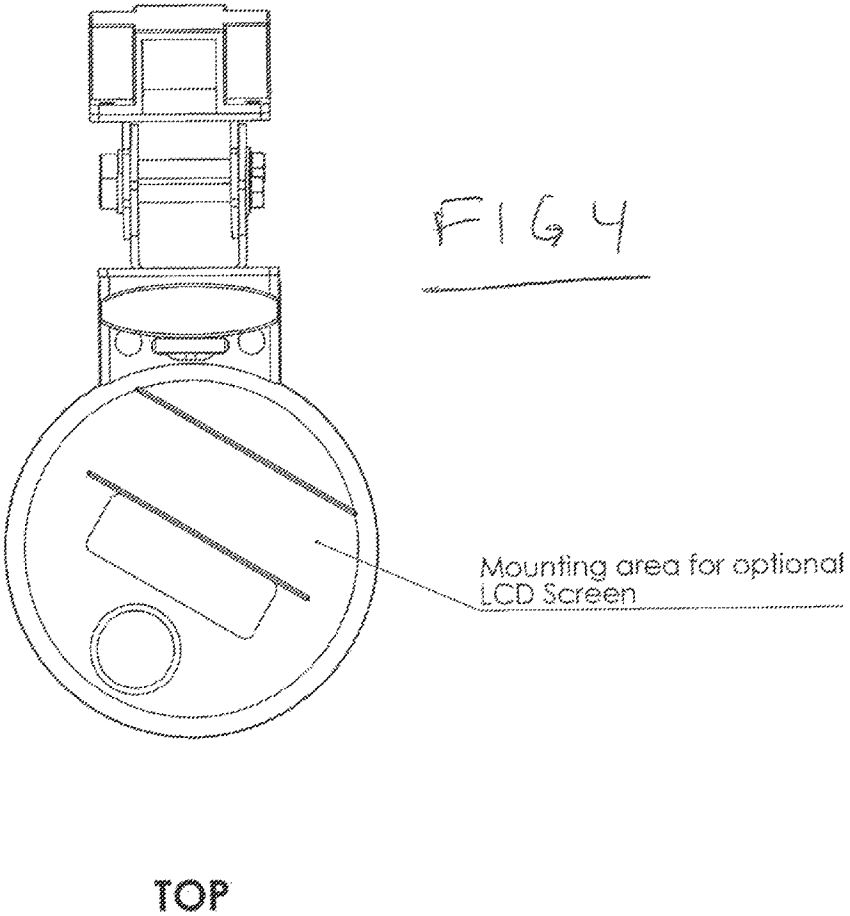
FIG. 4 is a top level view of the invention highlighting a mounting area for an optional LCD screen.
Figure 5:
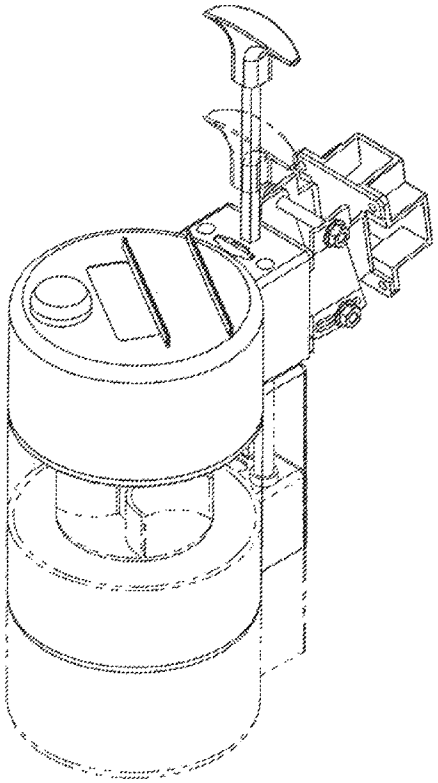
FIG. 5 is a perspective down facing view of the invention having a partial cutaway to detail the movement of the plunger.
Figure 6:
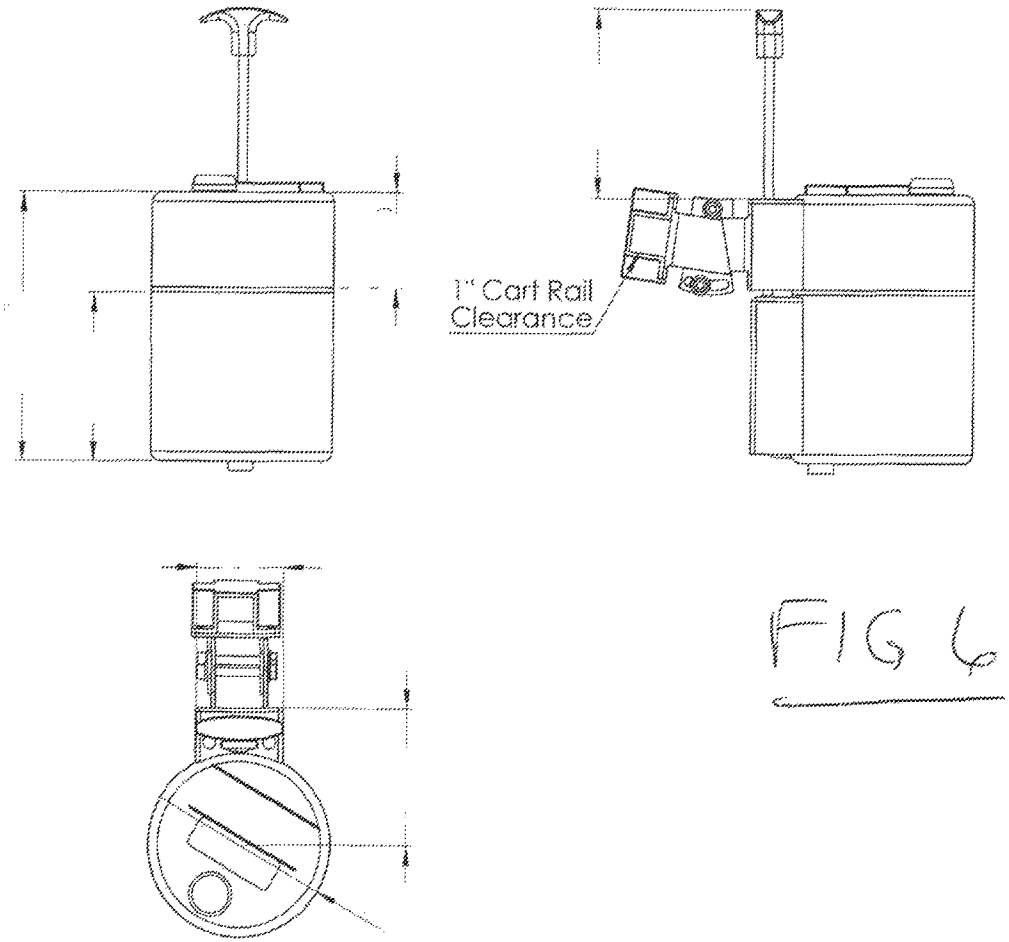
FIG. 6 shows three views, a front view, side view and top level view of the invention.
Figure 7:
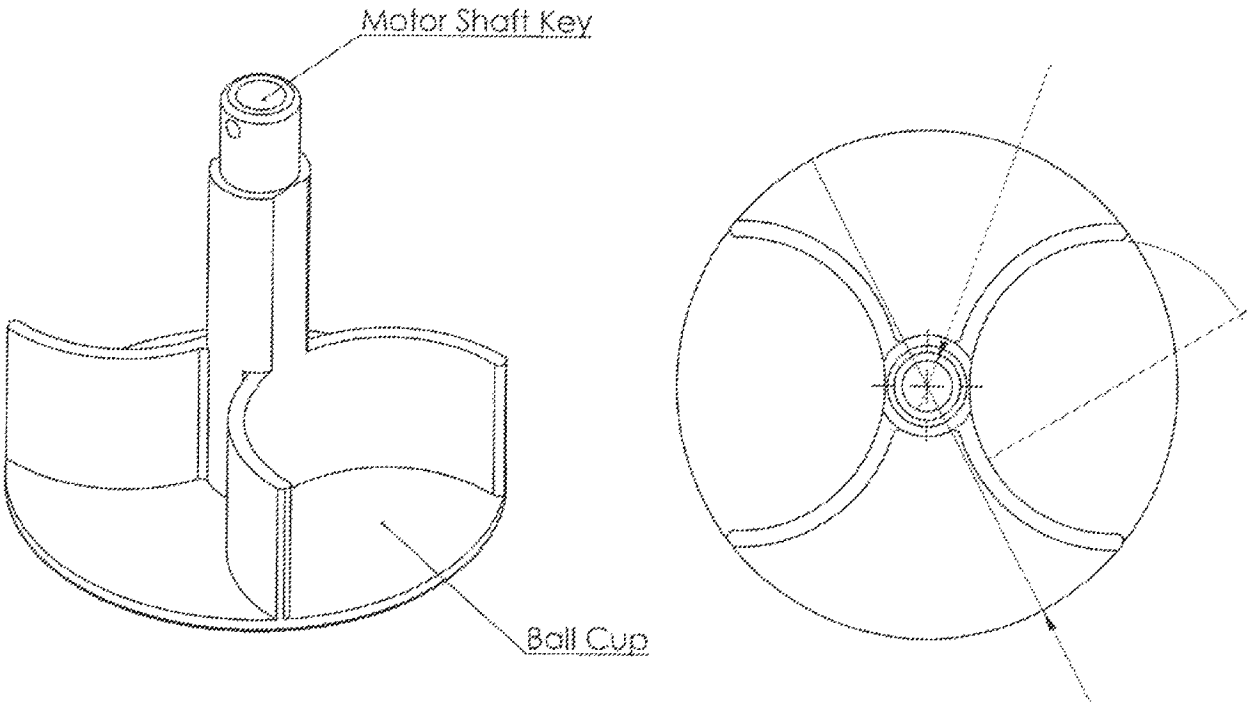
FIG. 7 shows two views, a perspective and a top view of the dual ball cradle with a detail of a motor shaft key for interfacing with a motor shaft.
Figure 8:
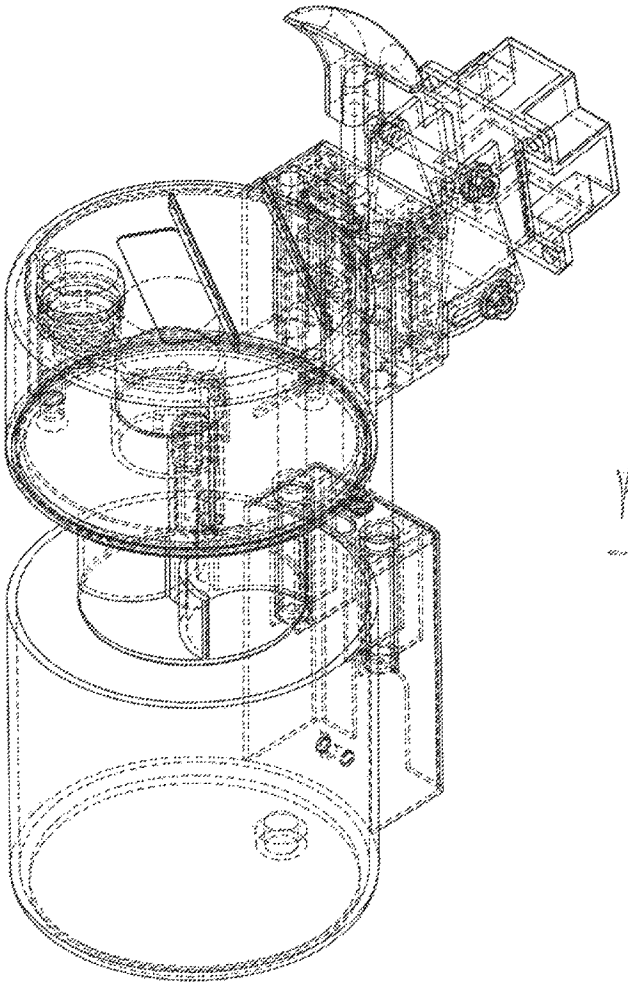
FIG. 8 is a ghosted view of the major components detail view of the invention showing major components and mounting hardware of the embodiment shown in FIG. 1.
Figure 9:
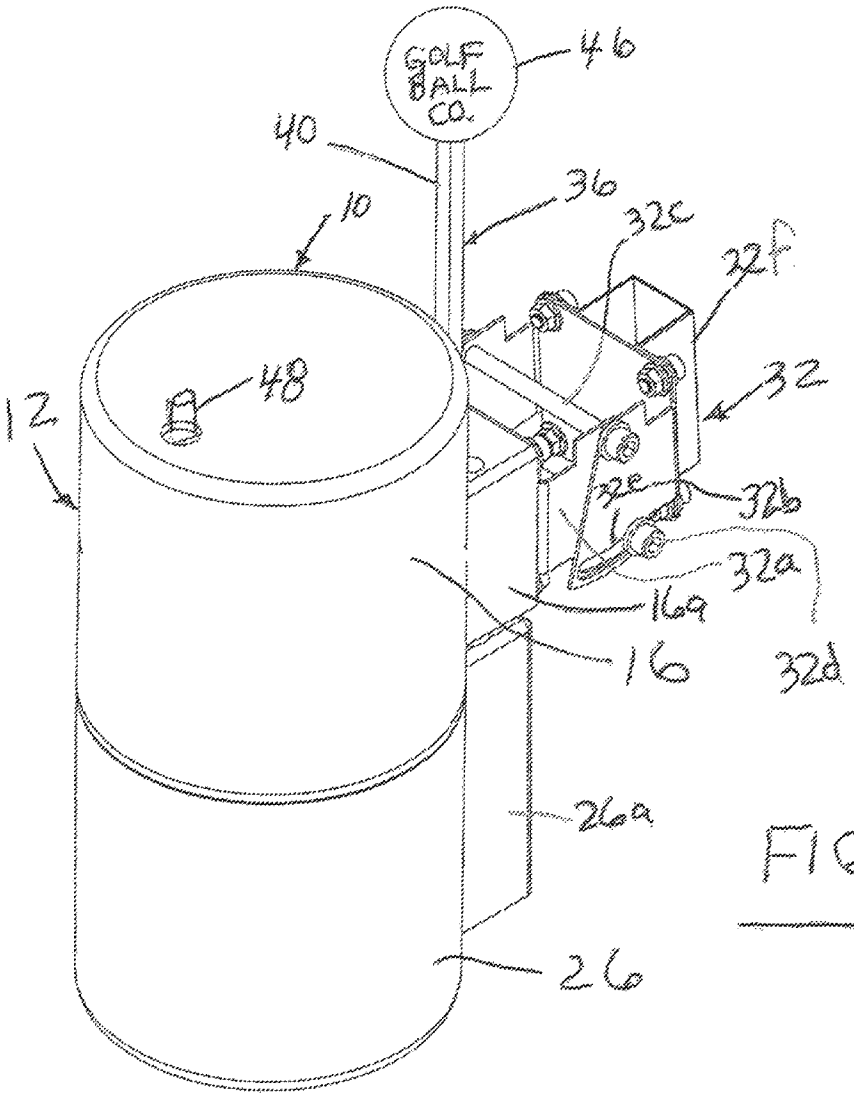
FIG. 9 is a perspective view of another embodiment golf ball washer of the invention showing major components and mounting hardware.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

U.S. Provisional Application 62/029,189, filed Jul. 25, 2014 is herein incorporated by reference.

A first embodiment is disclosed in FIGS. 1-8. A second embodiment is disclosed in FIGS. 9-15C.

FIGS. 9-15C illustrate a ball washing apparatus 10 according to a second embodiment of the invention. The ball washing apparatus 10 includes a ball washing body 12 connectable to a canopy support post of a golf cart utilizing a mounting apparatus 32. The ball washing body 12 includes a cap-shaped cover 16 which is removably sealed to a cap-shaped reservoir 26.

The body 12 includes an actuator 36 for opening and closing the reservoir 26 with respect to the cover 16. The actuator 36 includes a push rod 40 and a push knob 46. The push rod 40 comprises a square cross-section. The push rod is guided through a square hole 40*a* in a cover mount 12*a* (see FIG. 12A) and is fixed by adhesive, set screw, press fitting, or the like, into a square hole 40*b* in a reservoir mount 26*a* (see FIG. 13C). The push knob 46 can be an actual golf ball fixed to the push rod. The golf ball can have indicia on it identifying the golf ball manufacturer or any other business. This is for novelty and advertising purposes. A power push button 48 exposed through a top of the cover 16 can be pushed down to commence the ball washing operation.

The mounting apparatus 32 includes a stationary bracket 32*a* mounted to the cover mount 16*a* and an angle adjustable bracket 32*b* that is mounted to the stationary bracket via a pivot bolt 32*c* and a locking bolt 32*d*. The angle adjustable bracket includes a curved slot 32*e*. When the pivot bolt 32*c* and the locking bolt 32*d* are loosened, the angle adjustable bracket 32*b* can be pivoted about the pivot bolt 32*c* and the locking bolt relatively moves, although remaining stationary, through the curved slot as the curved slot moves with the pivoting of the angle adjustable bracket 32*b*. Once the angle is correctly adjusted the bolts 32*c*, 32*d* are tightened to lock the relative positions of the two brackets 32*a*, 32*b*. The bracket 32*b* is fastened to a clamping bracket 32*f* which tightly captures a canopy support post or the like on a golf cart or other structure. The ball washer can thus be adjusted in angle to be substantially vertical given an angled mounting post.

Figure 10:
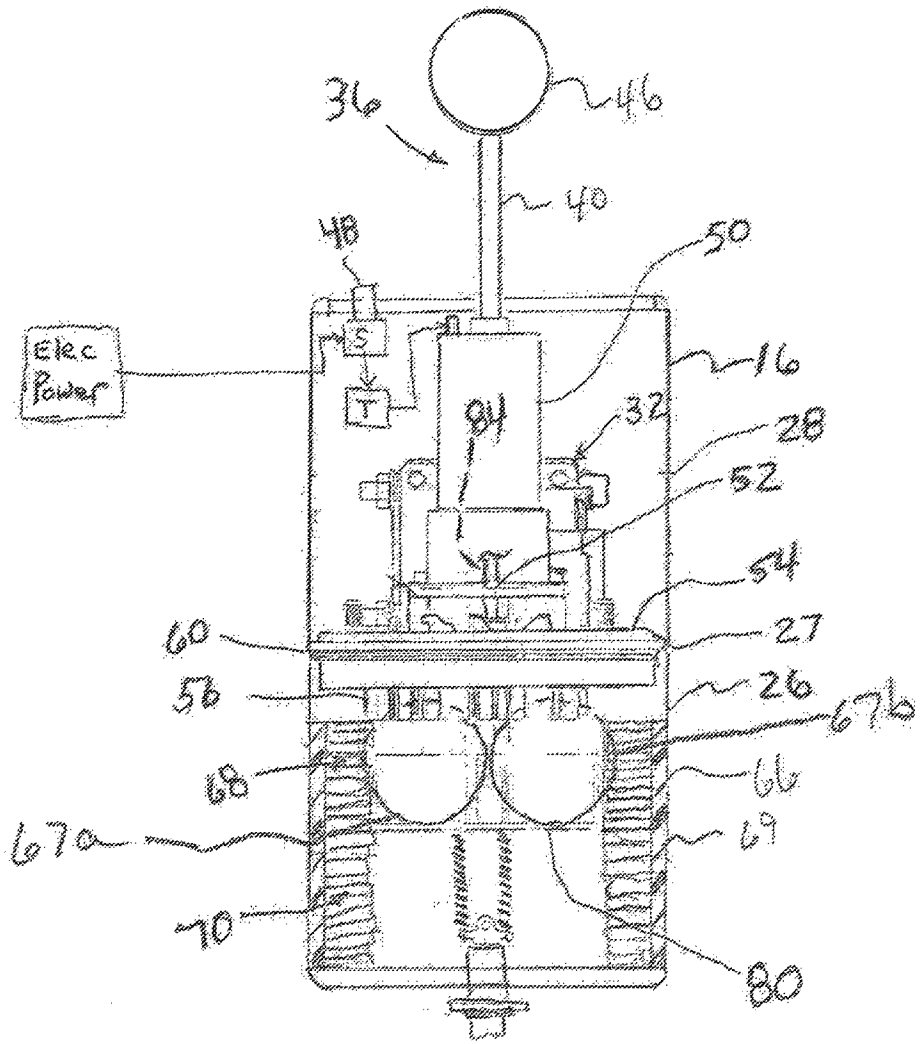
FIG. 10 is a front view of the ball washer of FIG. 9 detailing the gear motor and having a dual ball cradle, shown in a closed, operating configuration.

FIG. 10 illustrates in schematic form the push button 48 connected to a momentary switch which receives electric power from the golf cart battery or other power source or power generator. The switch is connected to a timer which delivers power for a pre-determined amount of time to an electric gearmotor 50. The gearmotor 50 is mounted on a motor mount plate 54 by screws. A disc shaped brush 56 having downwardly directed bristles is mounted to an underside of the plate 54.

FIG. 10 also illustrates the reservoir 26 is sealed along a top edge of the reservoir to the plate 54 by an o-ring or other flexible element 27 of the plate 54. An annular shaped brush 66 having upper, radially inward directed bristles 68 extending from an outer base ring 69 and facing golf balls 67*a*, 67*b* to be washed; and lower, radially inward directed bristles 70 extending from the outer base ring 69 is fit snugly within the reservoir 26. The brush 66 is reversible for a prolonged useful life by removing and inverting the brush and making the bristles 70 now face the golf balls 67*a*, 67*b*. Although only the left and right profiles of the bristles are shown it is to be understood that the bristles 68, 70 can extend around the inside surface the base ring 69 for 360 degrees. The reservoir 26 is designed to sealingly hold a ball washing fluid, e.g., water and soap.

Figure 15A:
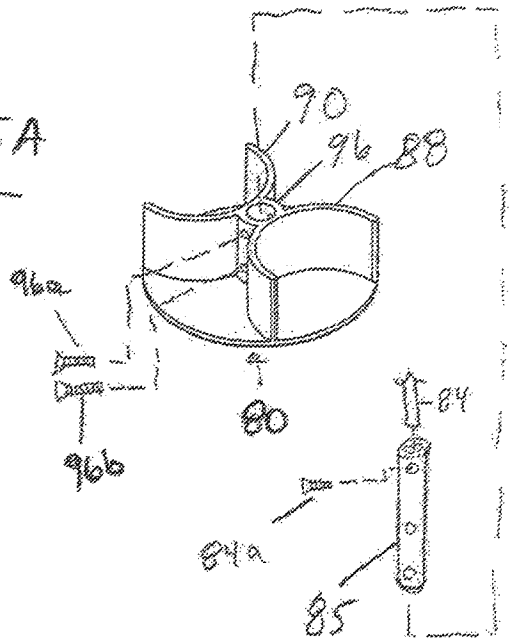
FIGS. 15A-15C are views of the ball tray portion of the ball washer of FIG. 9.
Figure 15B:
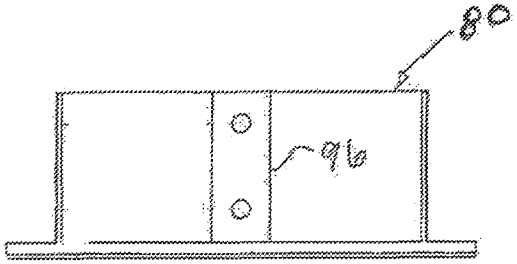
Figure 15C:
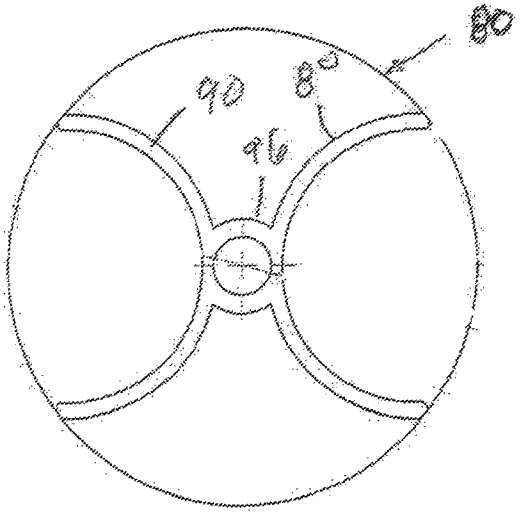
Figure 16:
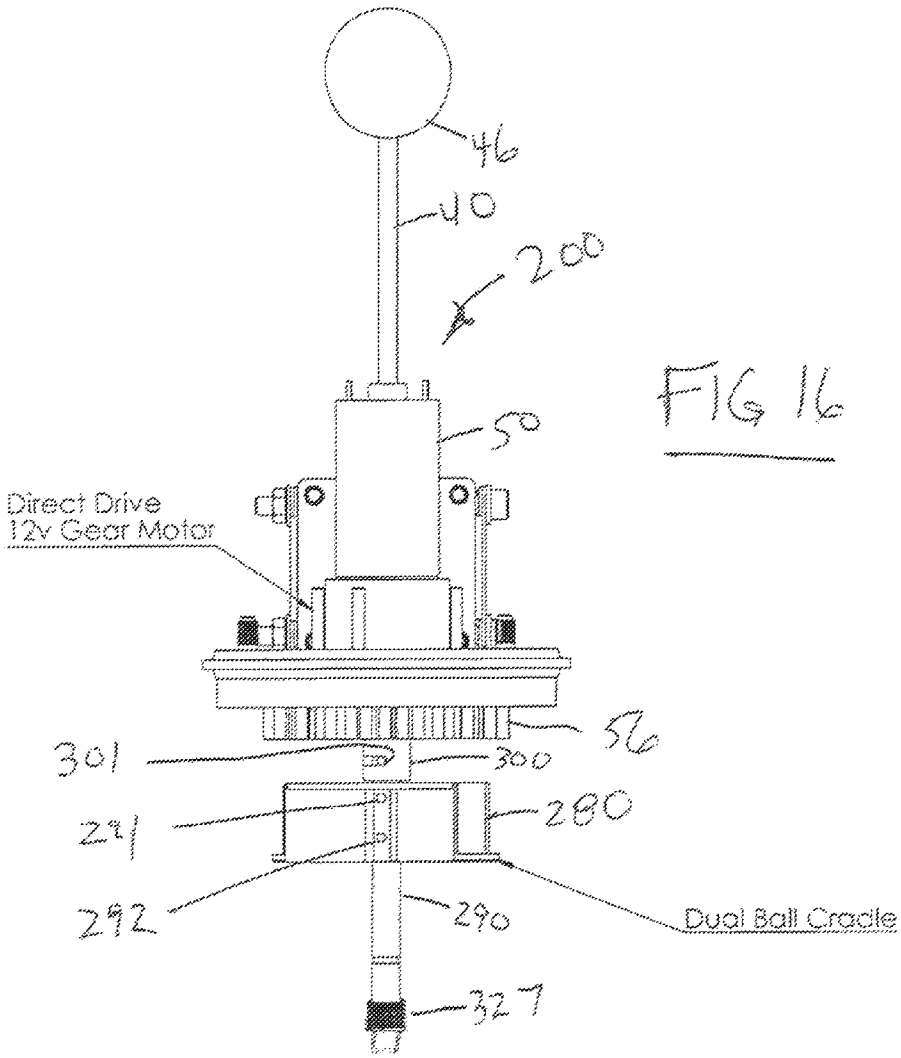
FIG. 16 is a fragmentary front view of an alternate ball washer.
Figure 17:
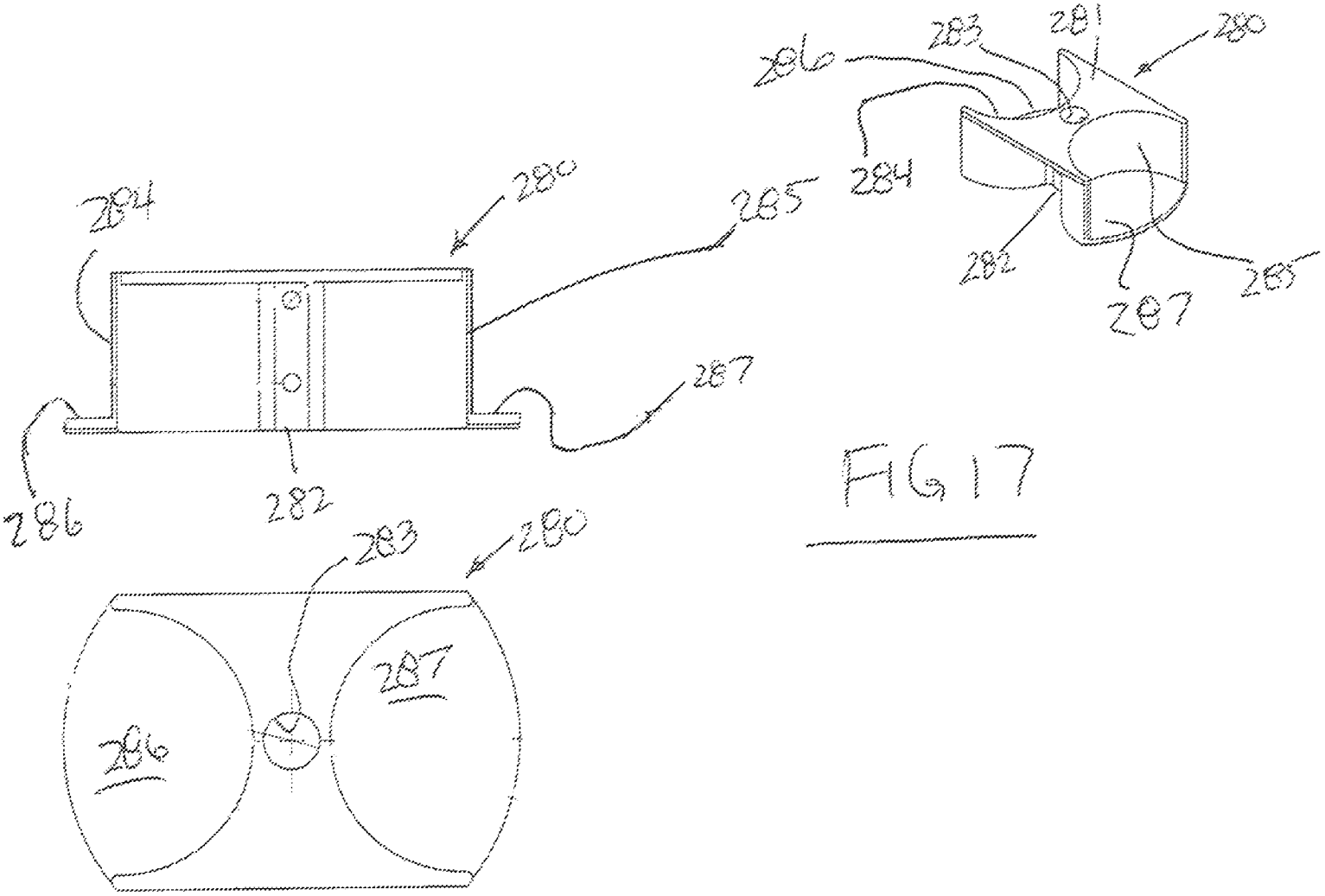
FIG. 17 are views of an alternate ball cradle as seen in FIG. 16.
Figure 18:
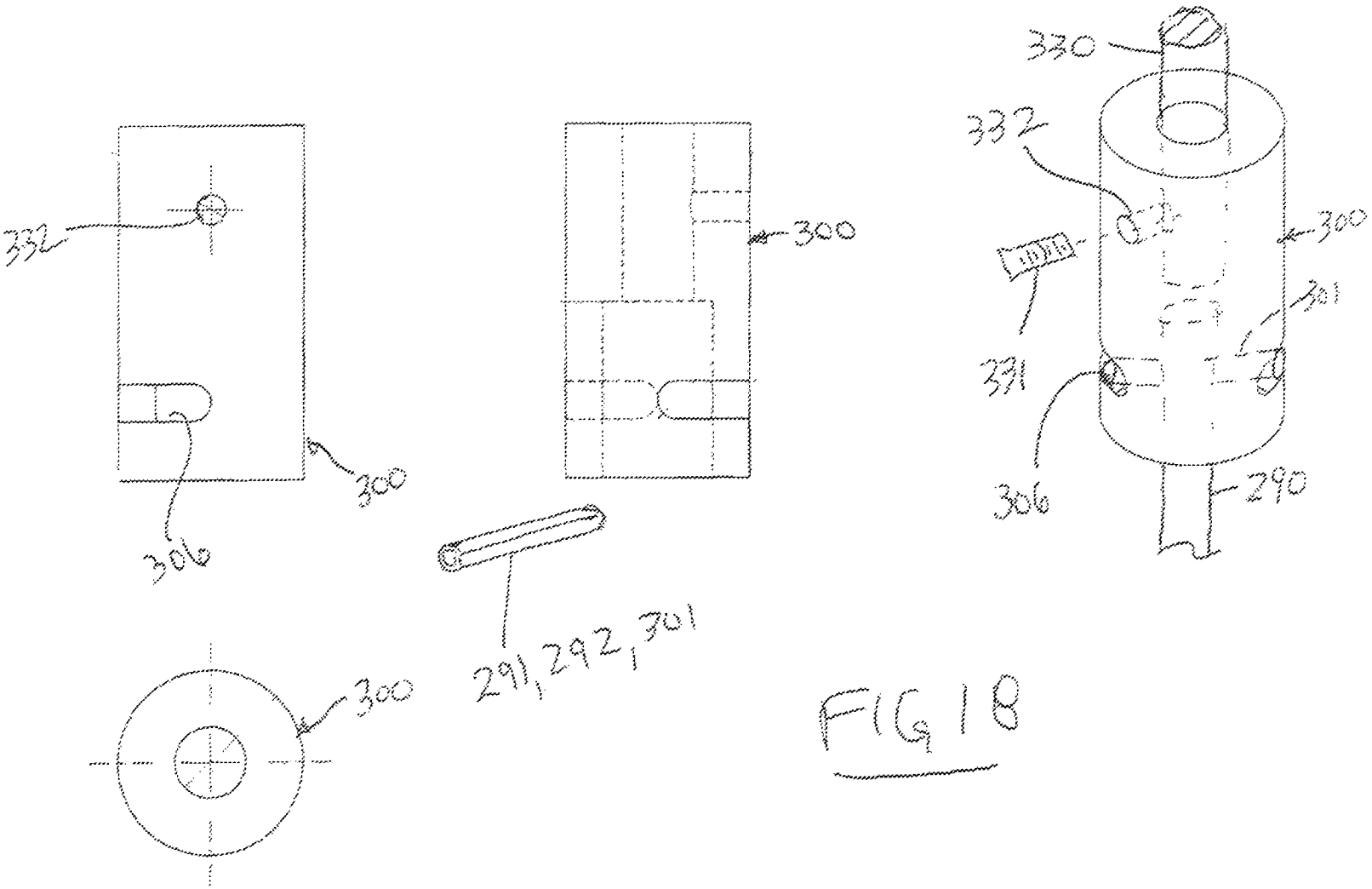
FIG. 18 are views of a shaft coupling used in the ball washer of FIG. 16.
Figure 19:
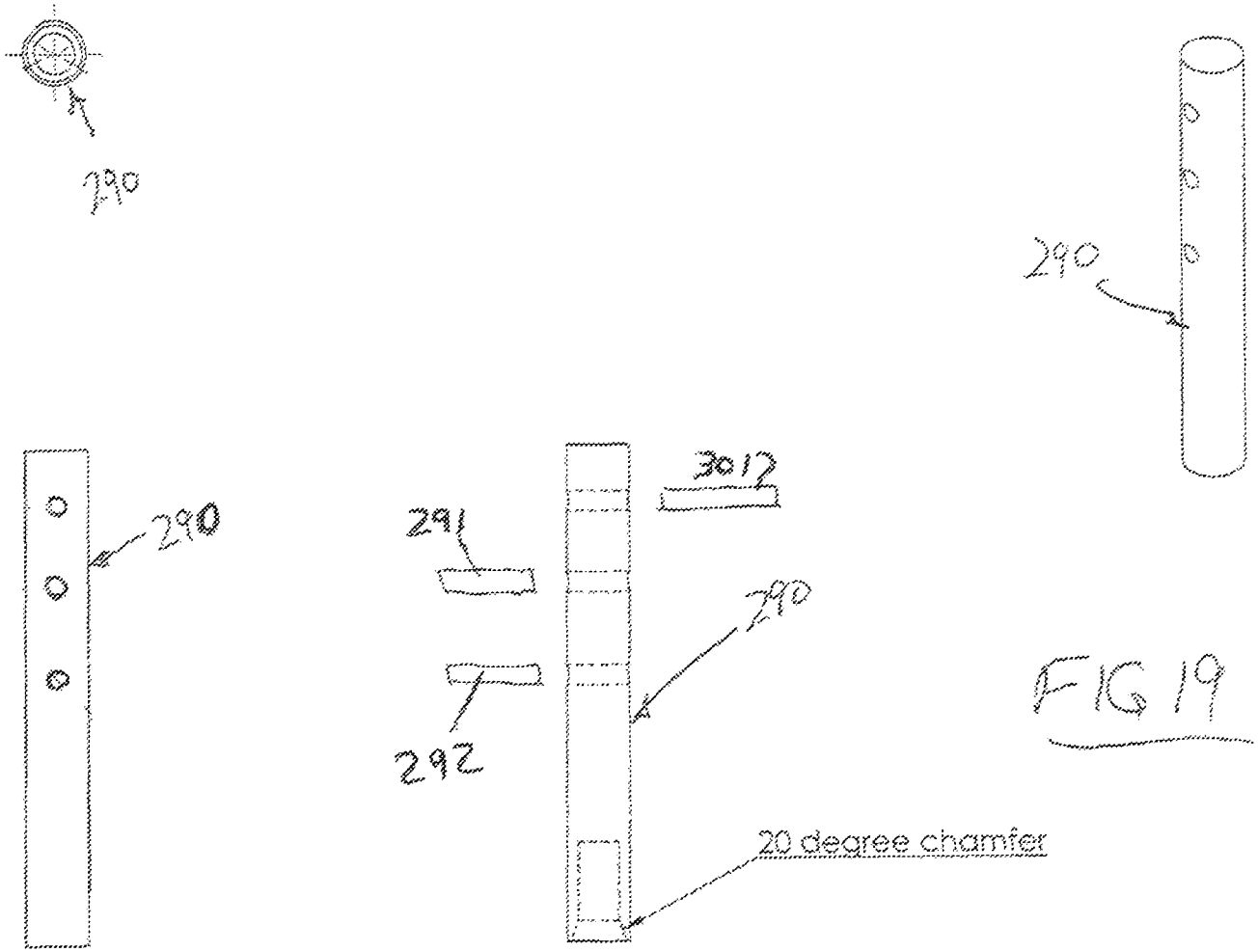
FIG. 19 are views of a shaft used in the ball washer of FIG. 16.

A ball cradle 80 is shown in FIGS. 15A-15C. The cradle 80 has the capacity to hold one or two golf balls 67*a*, 67*b* and is mounted to a downwardly extended rotary output motor shaft 84 of the motor 50 via a sleeve 85. A set screw 84*a* fixes the motor shaft 84 within the sleeve 85 and a pair of screws 96*a*, 96*b* fixes the sleeve 85 to a mount portion 96 of the ball cradle 80 via holes in the portion 96 and corresponding holes in the sleeve 85. The ball cradle 80 includes a circular ball supporting plate 86 and semi-circular ball side guides 88, 90.

Figure 10A:
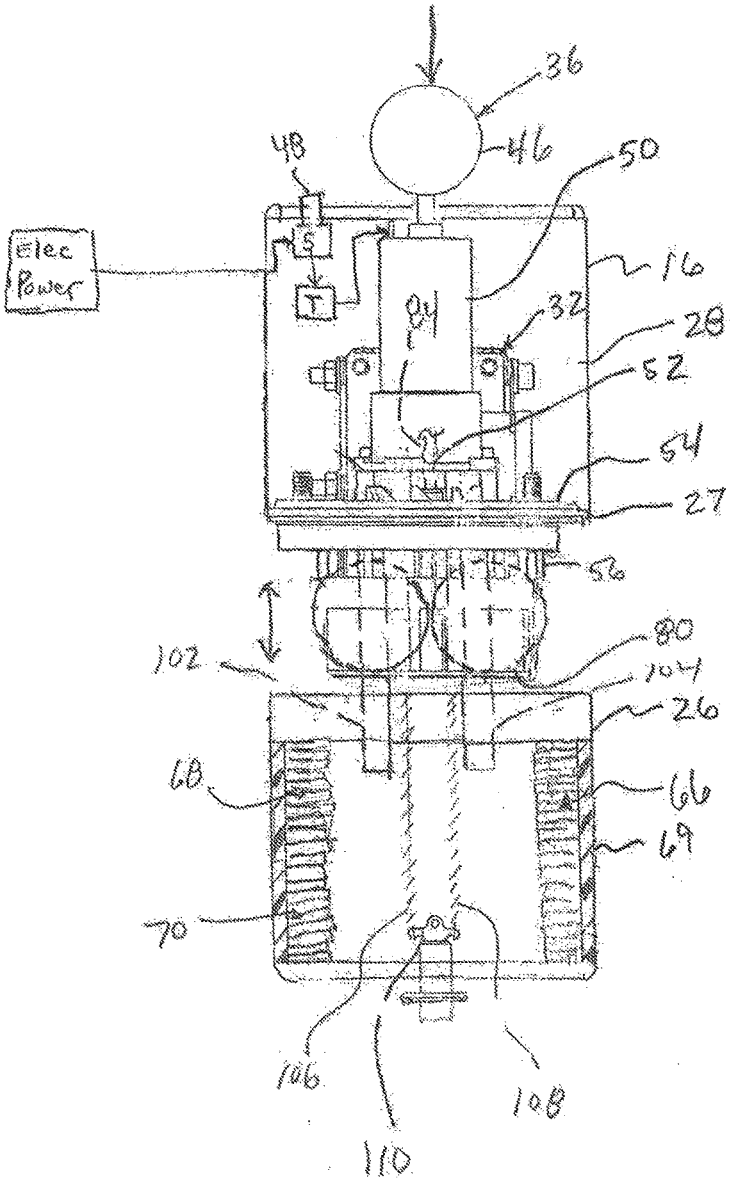
FIG. 10A is a front view of the ball washer of FIG. 10, shown in an open, loading/unloading configuration.
Figure 11:
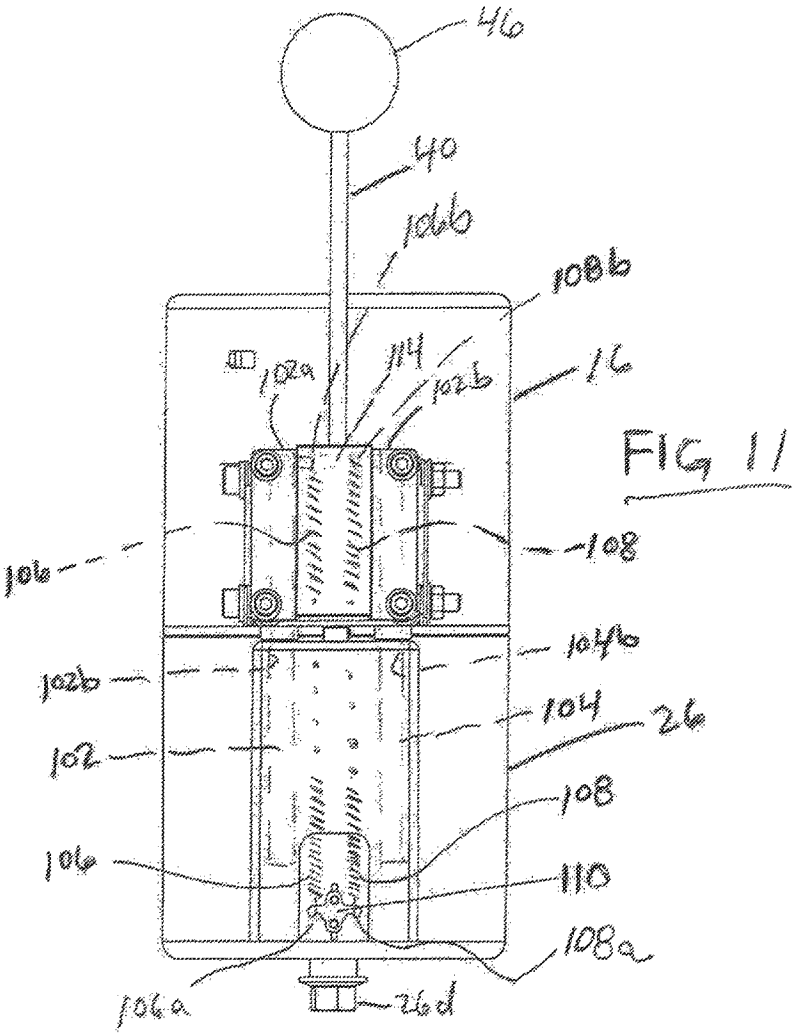
FIG. 11 is a rear view of the ball washer of FIG. 9.
Figure 12:
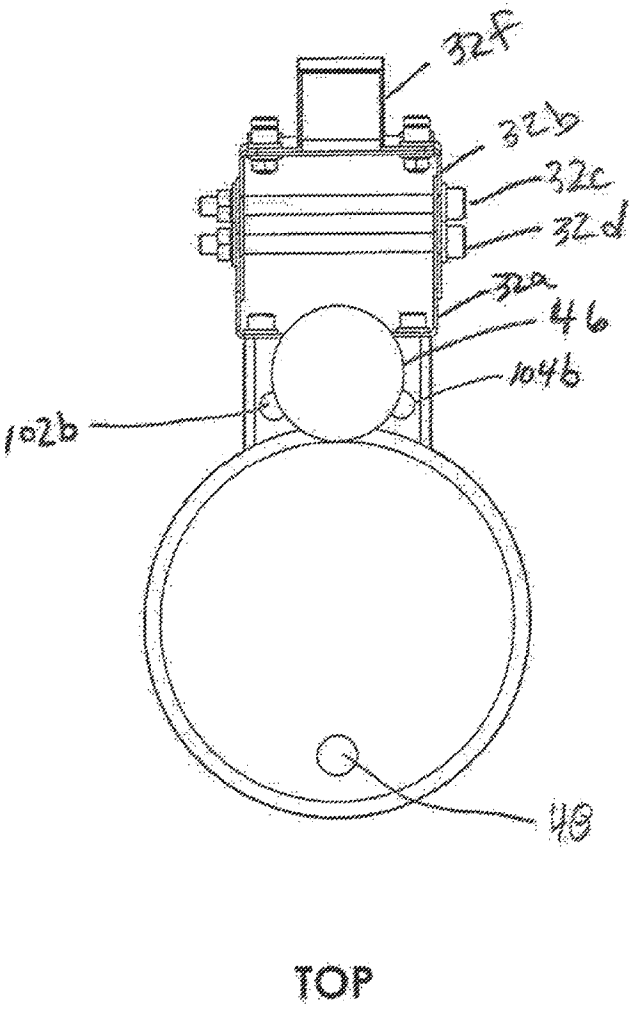
FIG. 12 is a top level view of the ball washer of FIG. 9.
Figure 12C:
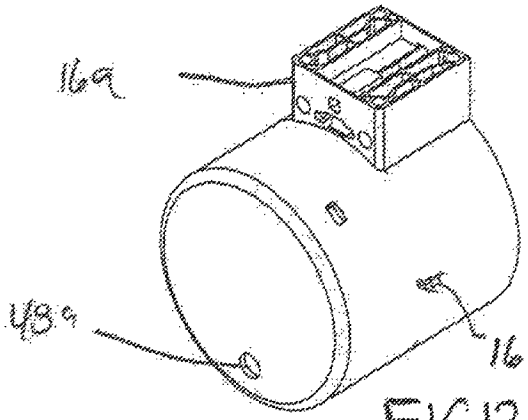
FIGS. 12A-12D are views of the top cap portion of the ball washer of FIG. 9.
Figure 12D:
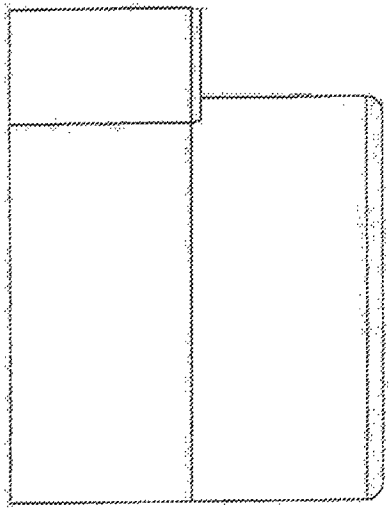
Figure 12B:
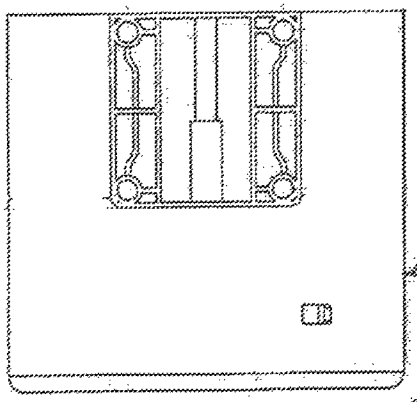
Figure 12A:
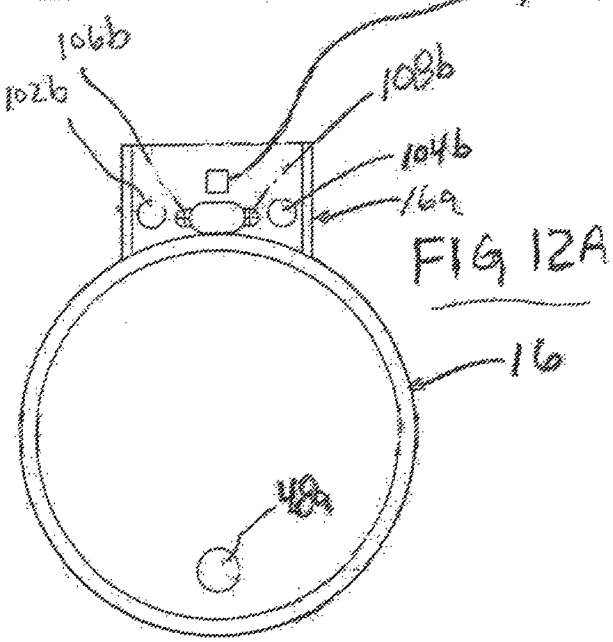

In order to guide the downward movement of the reservoir with respect to the cap, two guide rods 102, 104 are provided as shown in FIGS. 10A, 11 and 12. The guide rods are fixed to a top of the cover mounting assembly by adhesive or press fitting or other fixing means at points 102*a*, 104*a* respectively. The guide rods extend downward in parallel and are guided by guide holes 102*b*, 104*b* respectively in the reservoir mount.

In order for the reservoir to return to its closed operational position, two coil springs 106, 108 are provided as shown in FIGS. 10, 10A and 11. The springs 106, 108 are fixed at bottom ends 106*a*, 106*b* respectively to a spring hook 110 mounted to the reservoir mount. Top ends 106*b*, 108*b* respectively of the springs 106, 108 are fixed to a spring support 114 that is fixed to a top of the cover mount. Thus, when the reservoir is separated from the cap to load or unload golf balls as shown in FIG. 10A, the springs 106, 108 are stretched and the reservoir is urged back up toward the cap.

The plate 54 includes bosses 54*a* for screw mounting the motor 50 on one side and bosses 54*b* for screw mounting the brush 56 on the opposite side (see FIGS. 14A-14D).

Figure 13A:
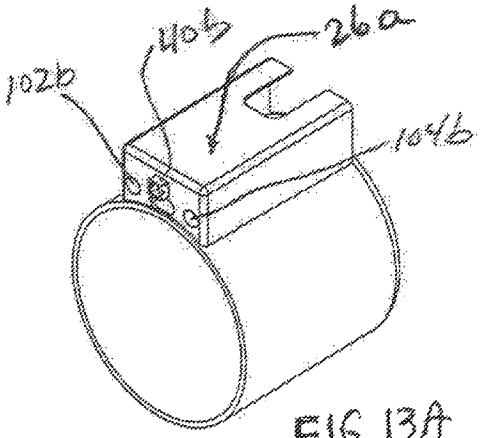
FIGS. 13A-013D are views of the bottom reservoir portion of the ball washer of FIG. 9.
Figure 13D:
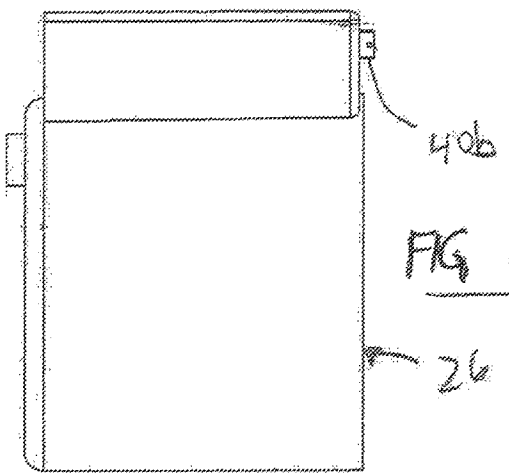
Figure 13B:
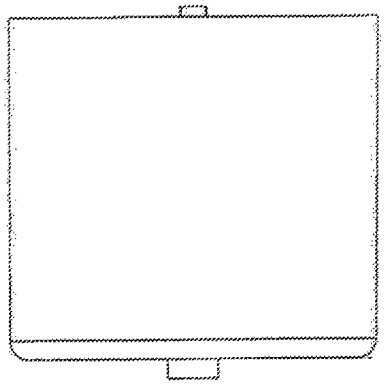
Figure 13C:
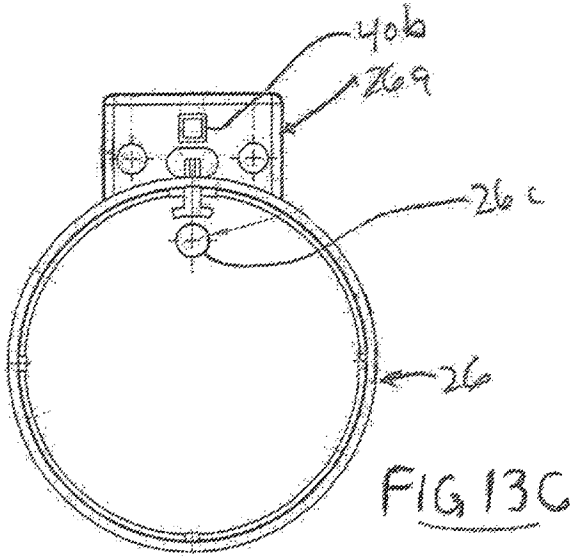
Figure 14A:
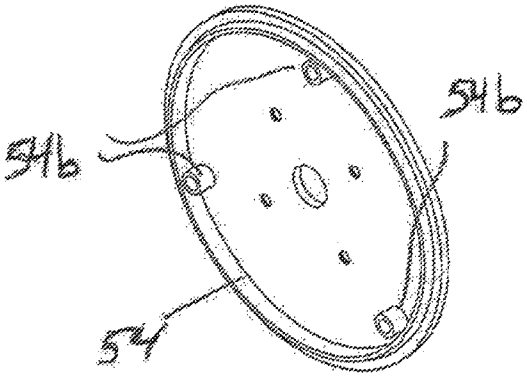
FIGS. 14A-14D are views of a motor mount portion of the ball washer of FIG. 9.
Figure 14D:
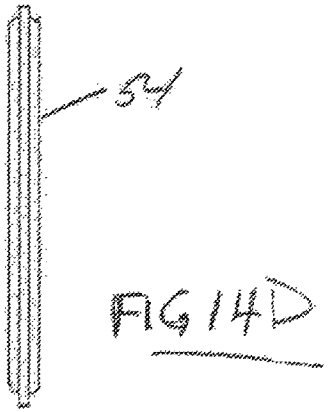
Figure 14B:
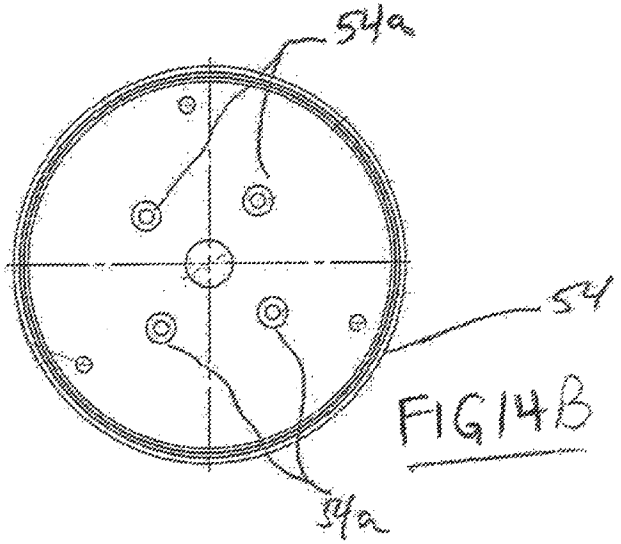
Figure 14C:
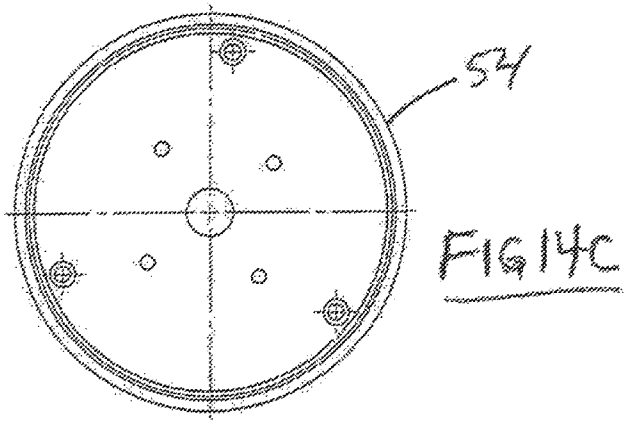

A threaded drain opening 26*c* for receiving a plug 26*d* is provided on the bottom of the reservoir (see FIGS. 11 and 13C).

The cover 16, the reservoir 26, the motor mount plate 54 and ball carriage 80 can all be composed of black UV ABS. Hardware can be aluminum, stainless steel or the like.

Figure 20:
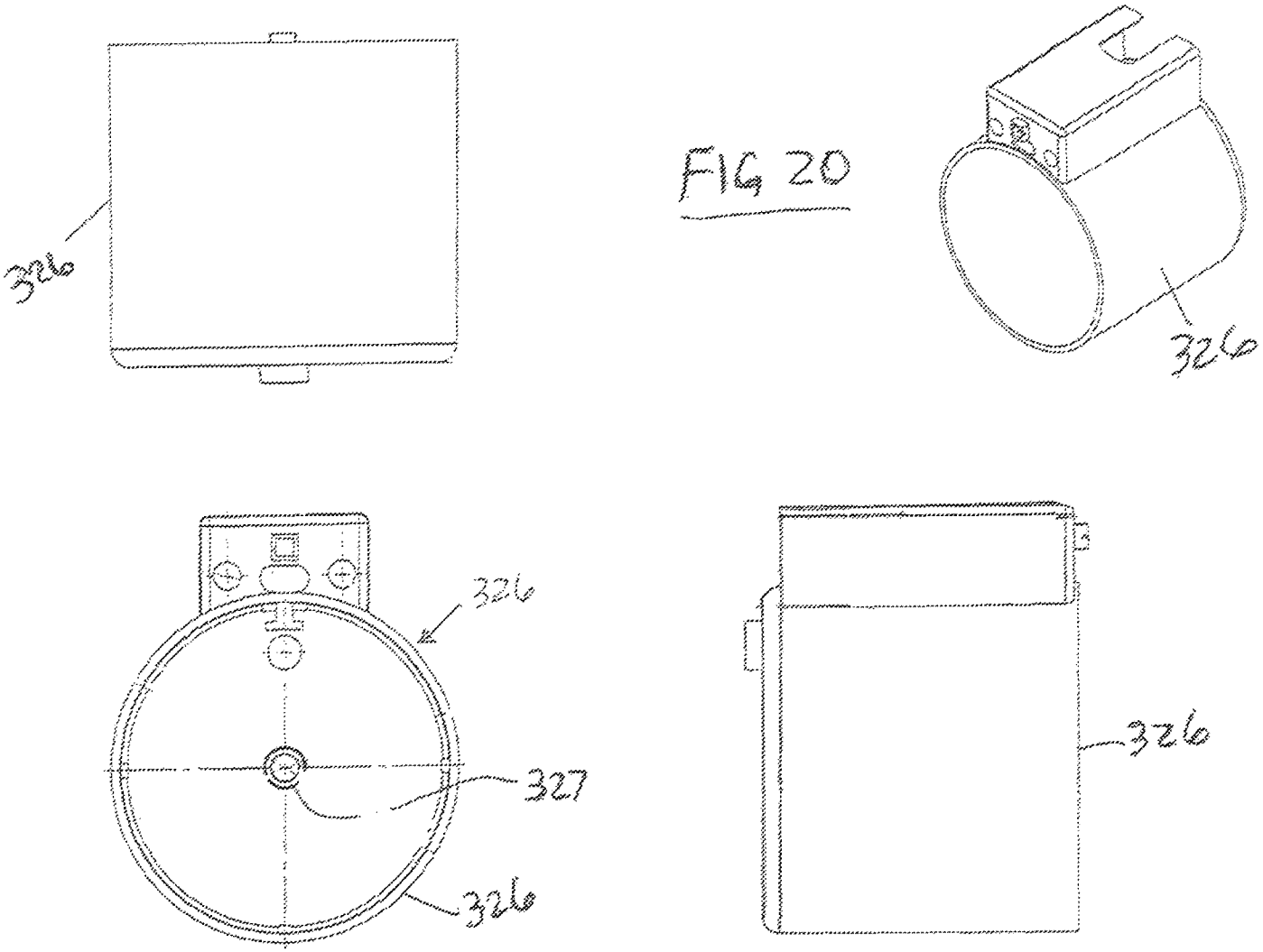
FIG. 20 are views of an alternate bottom reservoir portion of the ball washer of FIG. 16.
Figure 21:
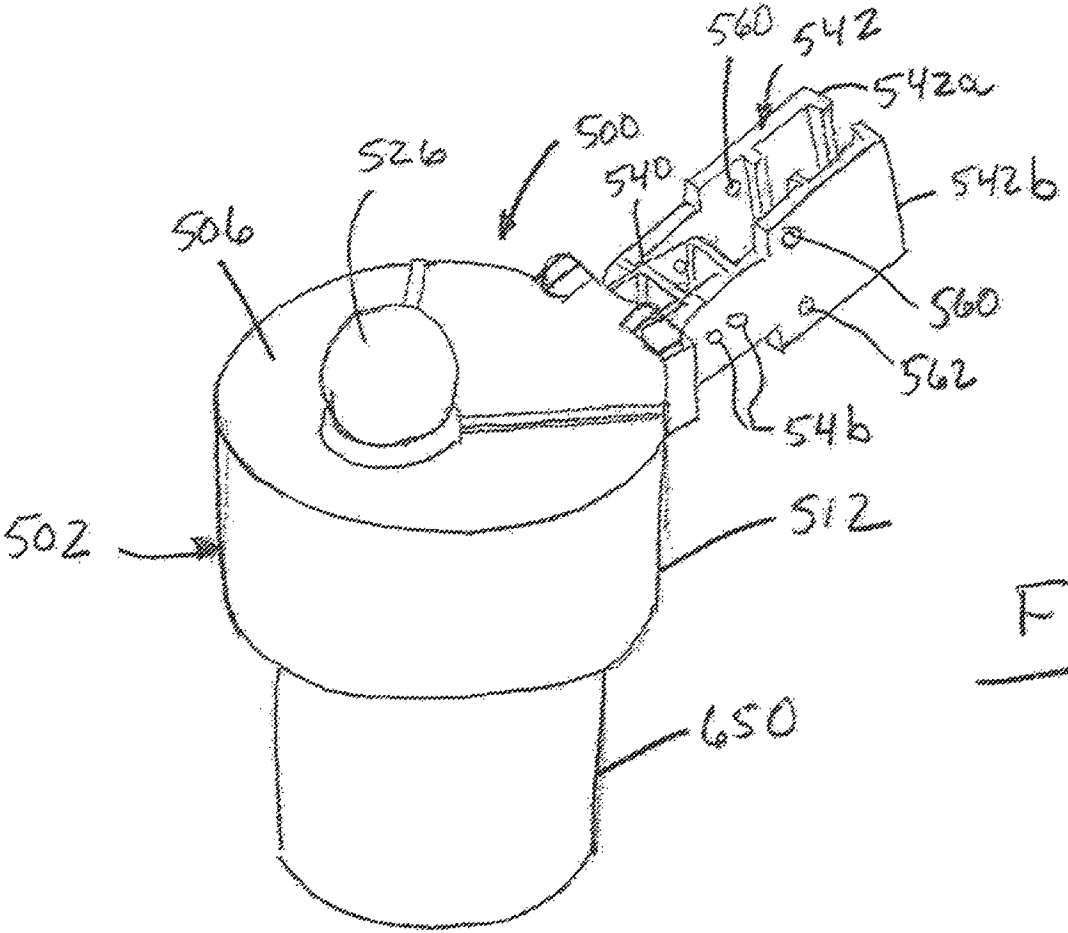
FIG. 21 is a perspective view of a further embodiment of a ball washing apparatus.
Figure 22:
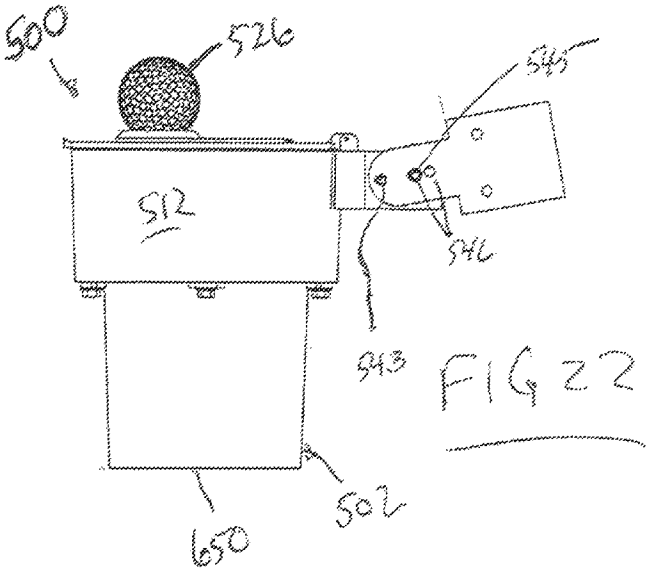
FIG. 22 is a side view of the embodiment of FIG. 21.
Figure 23:
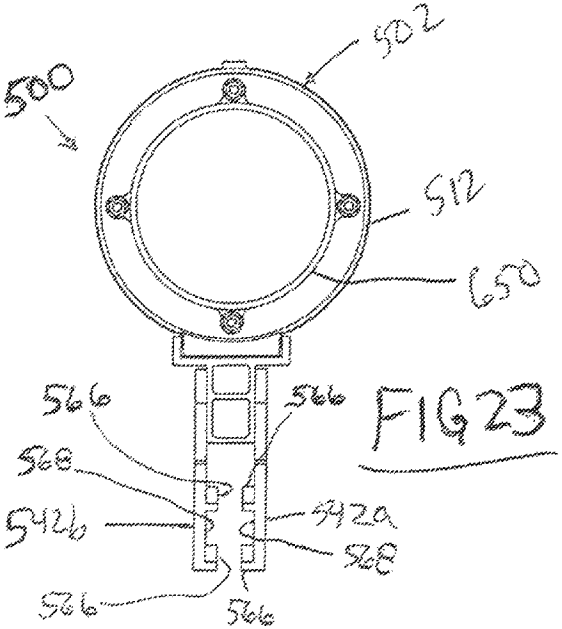
FIG. 23 is a bottom view of the embodiment of FIG. 21.

FIGS. 16-20 are views of an alternate embodiment ball washer 200. Some components are not shown to see underlying components. For example the cover 16 is not shown and the reservoir 326 is shown in FIG. 20. All the components of assembly of the ball washer 10 are included in the ball washer 200 and are identical and serve identical functions as in the ball washer 10, except as noted. According to this embodiment, an alternate ball cradle 280 is used that is fixed to a shaft 290 via two roller pins 291, 292 (shown also in FIG. 18). The shaft 290 is also coupled to a coupling 300 using a roller pin 301(shown also in FIG. 18). The coupling includes a semi-circumferential slot 306. The roller pin 301 is fixed into the shaft 290 and captured in the slot 306. The slot allows a rotational lost motion between the shaft 290 and the shaft 330 of the motor 50. Thus after the wash cycle is complete, and the ball washer opened, the user can manually rotate the ball cradle in the opposite direction of the motor turning direction, within the angular limit of the slot, to facilitate removal of the golf balls. This is convenient in the case that the motor stops with one of the balls in the back of the washer. The coupling 300 is attached to a motor shaft 330 of the gearmotor 50 (shown in FIG. 18) by a set screw 331 in a tapped hole 332 (shown also in FIG. 18).

The ball cradle 280 includes a top plate 281, a central portion 282 for receiving the shaft 290 through a hole 283, curved sidewalls 284, 285 for guiding golf balls and bottom walls 286, 287 for supporting golf balls.

FIG. 20 shows the reservoir 326 includes a brass bushing 327 fixed to the bottom of the reservoir that receives a bottom end of the shaft 290 when the reservoir is raised to the closed position for golf ball washing. The shaft extends 290 down into the bushing 327 to stabilize the rotation of the ball cradle from wobbling during the wash cycle.

A further embodiment is disclosed in FIGS. 21-26.

FIGS. 21-26 illustrate a ball washing apparatus 500. The ball washing apparatus 500 includes a ball washing body 502 connectable to a canopy support post of a golf cart utilizing a mounting apparatus 507. The ball washing body 502 includes a lid 506 which is hinged to a cap-shaped housing 512.

The body 502 includes a knob 526 for opening and closing the lid 506 with respect to the housing 512. The knob 526 is fastened to the lid with a fastener. The knob 526 can be in the form of a golf ball, or an actual golf ball. The golf ball can have indicia on it identifying the golf ball manufacturer or any other business. This is for novelty and advertising purposes.

The mounting apparatus 507 includes a stationary bracket 540 mounted to the housing 512, by screws or other means, and an angle adjustable bracket 542. The angle adjustable bracket 542 is comprised of two mirror image configured members 542*a*, 542*b*. The bracket 542 is mounted to the stationary bracket 540 via a pivot bolt 543 and nut passed through aligned pivot holes 544 through both brackets 540, 542, and a locking bolt 545 and nut that can be inserted through selectable holes 546 through both brackets 540, 542 to set an angular orientation between the two brackets 540, 542. To adjust the angle between the brackets 540, 542, the bolt 543 is loose while the bolt 545 is not installed into the holes 546. The bracket 542 can be pivoted with respect to the bracket 540 until a selectable hole grouping 546 is aligned to receive the bolt 545 which is passed through the selected holes 546. Once the angle is correctly adjusted, the bolts 543, 545 and corresponding nuts are tightened to lock the relative positions of the two brackets 540, 542. Unlike the previous embodiment, a curved slot is not used to adjust the angle, rather a plurality of holes 546 are used between the brackets 540, 542 which align or register corresponding to incremental angular orientations of the bracket 542 with respect to the bracket 540.

The bracket 542 is clamped to a canopy support post or the like on a golf cart or other structure. The bracket 542 is clamped by two bolts and corresponding nuts (not shown) that span through upper holes 560 and lower holes 562 respectively and when tightened, clamps the canopy support post between the members 542*a*, 542*b*. The members 542*a*, 542*b* include inward facing ridges 566 that define, with inward facing walls 568, a rectangular space for capturing the canopy support post in a confined clamped area that prevents angular tilting of the bracket 542 on the canopy support post. The ball washing apparatus can thus be attached at an angle to be substantially vertical given an angled mounting post.

Figure 25:
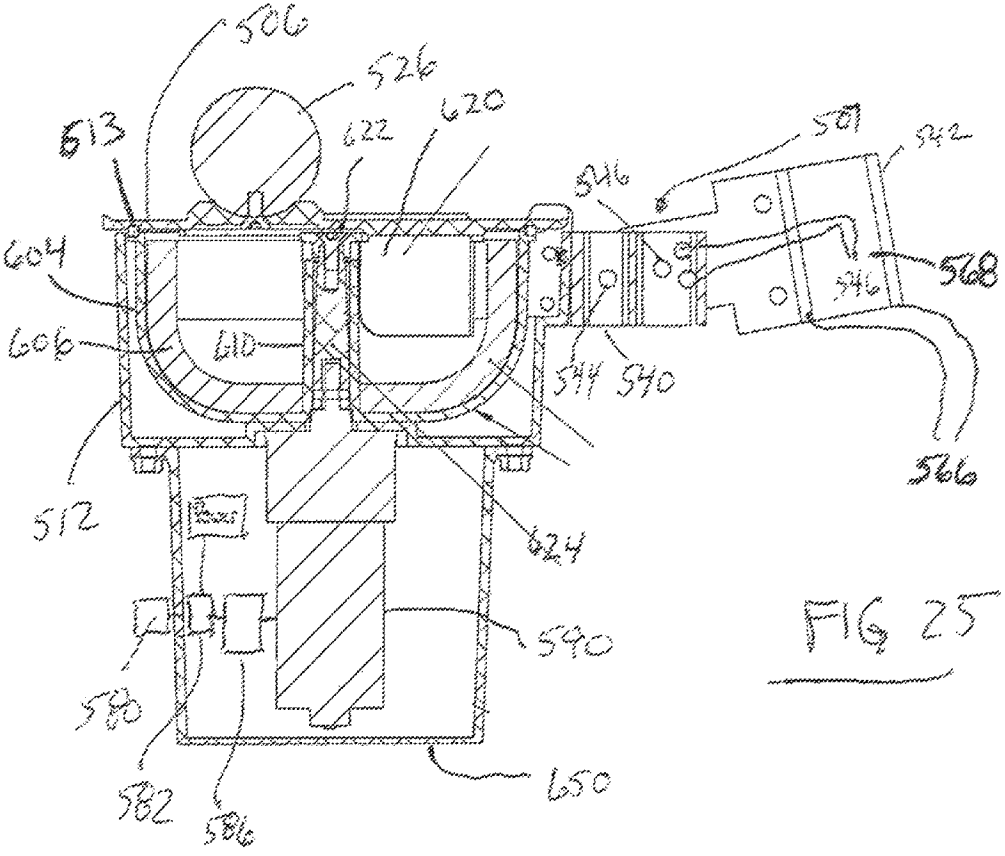
FIG. 25 is a sectional view taken generally along line 25-25 in FIG. 24.
Figure 24:
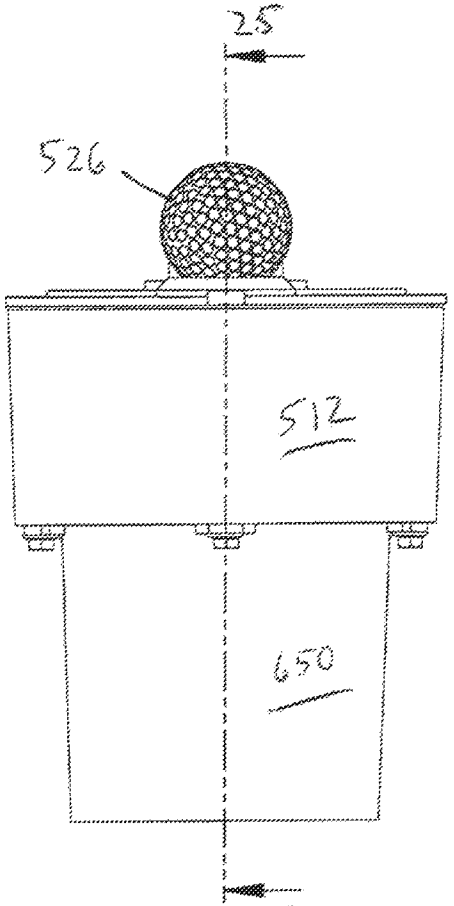
FIG. 24 is a front view of the embodiment of FIG. 21.
Figure 26:
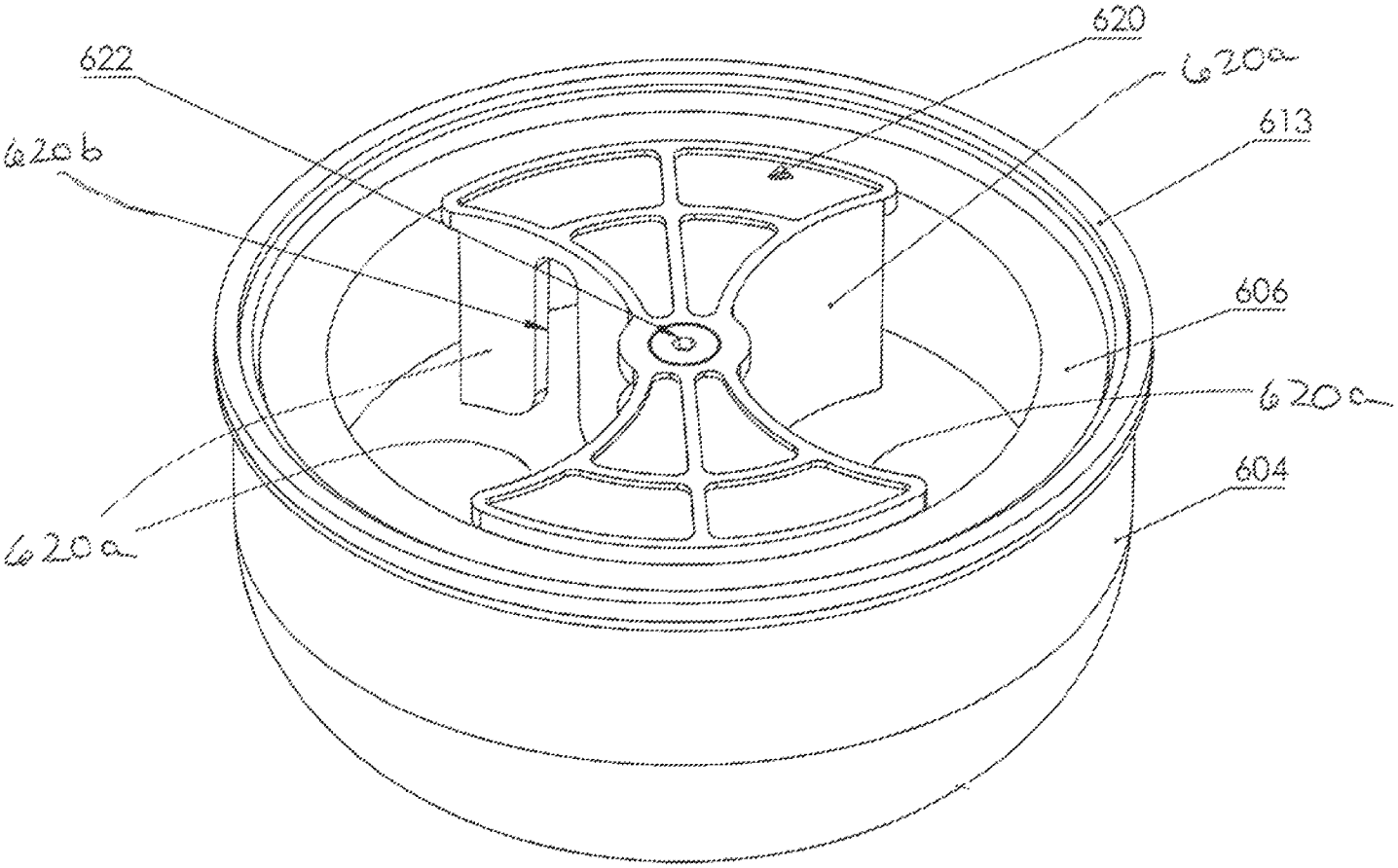
FIG. 26 is a perspective view of a portion of the apparatus of FIG. 21.

FIG. 25 illustrates in schematic form the push button 580 connected to a momentary switch 582 which receives electric power from the golf cart battery or other power source or power generator. The switch is connected to a timer 586 which delivers power for a pre-determined amount of time to an electric gearmotor 590. As an alternative to the push button 580, the closing of the lid 506 can trigger the timer 586. Opening of the lid can automatically stop the motor.

The gearmotor 590 is mounted to a bottom of the housing 512 by screws or other means. A cup shaped basin 604 has a cup shaped scrubbing pad 606 within. The basin is configured to hold cleaning fluid for washing the golf balls. The basin 604 includes a central pipe 610. The pad 606 includes a central hole for allowing the pipe to extend therethrough so that the pad can be fit snugly down onto the bottom of the basin and rising up along the walls of the basin. A rubber gasket 613 seals the lid 506 to an upper rim of the basin 604 when the lid is closed.

A ball paddle body 620 (FIG. 26) is mounted to a drive shaft 624 via a fastener 622. The ball paddle body 620 includes four curved paddles 620*a* curved toward each other in pairs to hold two golf balls, one golf ball between each pair of paddles that are curved toward each other. The drive shaft 624 is connected to the gearmotor 590. The ball paddle body 620 fits snuggly between the pipe and the pad and is configured to receive two golf balls. The paddles 620*a* have slots 620*b* to allow cleaning fluid to pass through the paddles. The basin and pad are stationary with respect to the housing 512 while the gearmotor 590 and the drive shaft spin the paddles. During operation the golf balls spin revolve with the spinning paddle in the cleaning fluid and are cleaned by contact with the pad. The golf balls will also tend to spin during revolution of the golf balls about the spinning axis of the ball paddle body 620.

A cup shaped cover 650 is fastened to a bottom of the housing 512 and encloses the gearmotor 590 and electronics.

The paddles 620 are removable through the top by opening the lid 506 and unfastening the fastener 622. The pad 606 is then removable through the top, as is the basin 604. The basin pipe 610 slides upward over the shaft 624. The parts can be cleaned easily or replaced and reinstalled.

The lid 506, housing 512 and cover 650 are preferably impact and UV resistant plastic.

In operation, the basin 604 is filled with cleaning fluid, the lid 506 is opened, two golf balls are inserted into the wash basin 604 onto the scrubbing pad 606, each golf ball fit within two paddles 620*a*. The lid 506 is closed and the start button 580 is activated to begin a 15 second wash cycle. The wash cycle shuts off after 15 seconds.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. An automatic golf ball washer comprising:

a top lid and a bottom basin capable of being substantially closed when brought together, the top lid openable with respect to the basin by pivoting of the lid from the basin;

a plurality of paddles arranged in the basin defining two spaces to receive two golf balls into the two spaces, the two spaces separated by at least one paddle of the plurality of paddles, the paddles mounted for rotation within the basin about a center axis of rotation;

a motor housed below the basin connected to the paddles to spin the plurality of paddles about the center axis of rotation to revolve the golf balls around the center axis of rotation;

the basin configured to hold a quantity of cleaning fluid;

wherein the paddles comprise solid surfaces for pushing the golf balls to revolve within the basin.

2. The ball washer according to claim 1, wherein the basin has a central pipe and the motor includes a drive shaft that extends upward through the central pipe and is attached to the plurality of paddles from above.

3. The ball washer according to claim 1, wherein a scrubbing surface is applied to an inside surface of the basin in order to scrub golf balls placed in the basin.

4. The ball washer according to claim 1, wherein the motor includes a vertical drive shaft that is coaxial with a center axis of rotation of the paddles.

5. The ball washer according to claim 4, wherein the basin comprises a central pipe and the drive shaft extends up through the central pipe and the drive shaft is attached to the paddles above the central pipe.

6. The ball washer according to claim 1, comprising a housing that surrounds the motor and the basin, a bracket attached to the housing and having an attachment for attaching to a golf cart canopy support post.

7. The ball washer according to claim 6, wherein the attachment comprises a clamp for clamping to the golf cart canopy support post.

8. The ball washer according to claim 7, wherein the bracket is articulated and includes a rotatable joint to adjust the angle of the housing to be substantially vertical despite the angle of the canopy support post.

9. The ball washer according to claim 1, wherein the plurality of paddles are arranged such that the two spaces for golf balls are arranged diametrically opposed across the center axis of rotation of the paddles.

10. An automatic golf ball washer comprising:

a top lid and a bottom basin capable of being substantially closed when brought together, the top lid openable with respect to the basin by pivoting of the lid from the basin;

a plurality of paddles arranged in the basin defining two spaces to receive two golf balls into the two spaces, the two spaces separated by at least one paddle of the plurality of paddles, the paddles mounted for rotation within the basin about a center axis of rotation;

a motor housed below the basin connected to the paddles to spin the plurality of paddles about the center axis of rotation to revolve the golf balls around the center axis of rotation;

the basin configured to hold a quantity of cleaning fluid;

wherein a scrubbing surface is applied to an inside surface of the basin in order to scrub golf balls placed in the basin;

wherein the paddles comprise solid surfaces for pushing the golf balls to revolve in the basin;

wherein the plurality of paddles are arranged such that the two spaces for golf balls are arranged diametrically opposed across the center axis of rotation of the paddles;

wherein the motor includes a vertical drive shaft that is coaxial with the center axis of rotation of the paddles;

wherein the basin comprises a central pipe and the drive shaft extends up through the central pipe and the drive shaft is attached to the paddles above the central pipe;

comprising a housing that surrounds the motor and the basin, and a bracket attached to the housing and having an attachment for attaching to a golf cart canopy support post;

wherein the attachment comprises a clamp for clamping to the golf cart canopy support post;

wherein the bracket is articulated and includes a rotatable joint to adjust the angle of the housing to be substantially vertical despite the angle of the canopy support post.

* * * * *